United States Patent [19]

Pasic

[11] 4,196,663

[45] Apr. 8, 1980

[54] HOLD-DOWN ACCELERATION DEVICE

[75] Inventor: James A. Pasic, Montesano, Wash.

[73] Assignee: Ovalstrapping, Inc., Hoquiam, Wash.

[21] Appl. No.: 14,066

[22] Filed: Feb. 22, 1979

Related U.S. Application Data

[63] Continuation-in-part of Ser. No. 908,814, May 24, 1978.

[51] Int. Cl.[2] ..... B65B 13/20

[52] U.S. Cl. ..... 100/7; 100/3; 100/26; 100/278; 100/295; 198/836

[58] Field of Search ..... 100/3, 7, 278, 270, 100/153, 25, 26, 177, 178, 222, 295; 198/836

[56] References Cited

U.S. PATENT DOCUMENTS

| | | | |
|---|---|---|---|
| 1,920,539 | 8/1933 | White | 100/153 X |
| 3,198,105 | 8/1965 | Smith | 100/3 |
| 3,348,473 | 10/1967 | Luy | 100/7 |

*Primary Examiner*—Billy J. Wilhite

*Attorney, Agent, or Firm*—Seed, Berry, Vernon & Baynham

[57] ABSTRACT

A hold-down beam is provided on a rapid acceleration conveyor to hold articles, such as an unstable stack of newspapers, tightly against the conveyor for providing frictional engagement between the stack and the conveyor and allow the upper part of the stack to move with the conveyor so that the stack will not topple. Compression blocks are provided at adjustably spaced locations on the bar for pressing bowed stacks.

3 Claims, 3 Drawing Figures

HOLD-DOWN ACCELERATION DEVICE

CROSS REFERENCE TO RELATED APPLICATIONS

This application is a continuation-in-part of application Ser. No. 908,814, filed May 24, 1978.

BACKGROUND OF THE INVENTION

1. Field of the Invention

This invention pertains to high-speed conveyors, and more particularly, to conveyors of the type used in conjunction with a strapping machine especially where the strapping machine is strapping unstable articles such as stacks of newspaper and for compacting the stacks at a strapping location on the strapping machine.

2. Description of the Prior Art

Strapping machines heretofore known have been unable to move stacks of paper through the strapping station of the machine at very high speeds. One of the reasons is the fact that the stack of newspapers is very unstable requiring that it be accelerated and decelerated slowly. One attempt to provide more stability to the stack has been to place a spring biased wheel on the top of the stack to hold the stack tightly against the lower conveying surface. Another technique has been to place a second conveyor on the top of the stack and to attempt to drive both of the conveyors synchronously at the same acceleration rates. Neither of these techniques has proven successful.

Still a further problem with strapping machine is that frequently the stack is not perfectly rectangular but rather is bowed up at the bottom because of inserts in the stack. This makes rapid conveying of such stacks very difficult.

SUMMARY OF THE INVENTION

It is an object of this invention to provide an inexpensive and simple accelerating hold-down device.

It is another object to provide a stack hold-down device for rapidly accelerating bowed stacks.

DETAILED DESCRIPTION OF THE PREFERRED EMBODIMENTS

Figure 1:
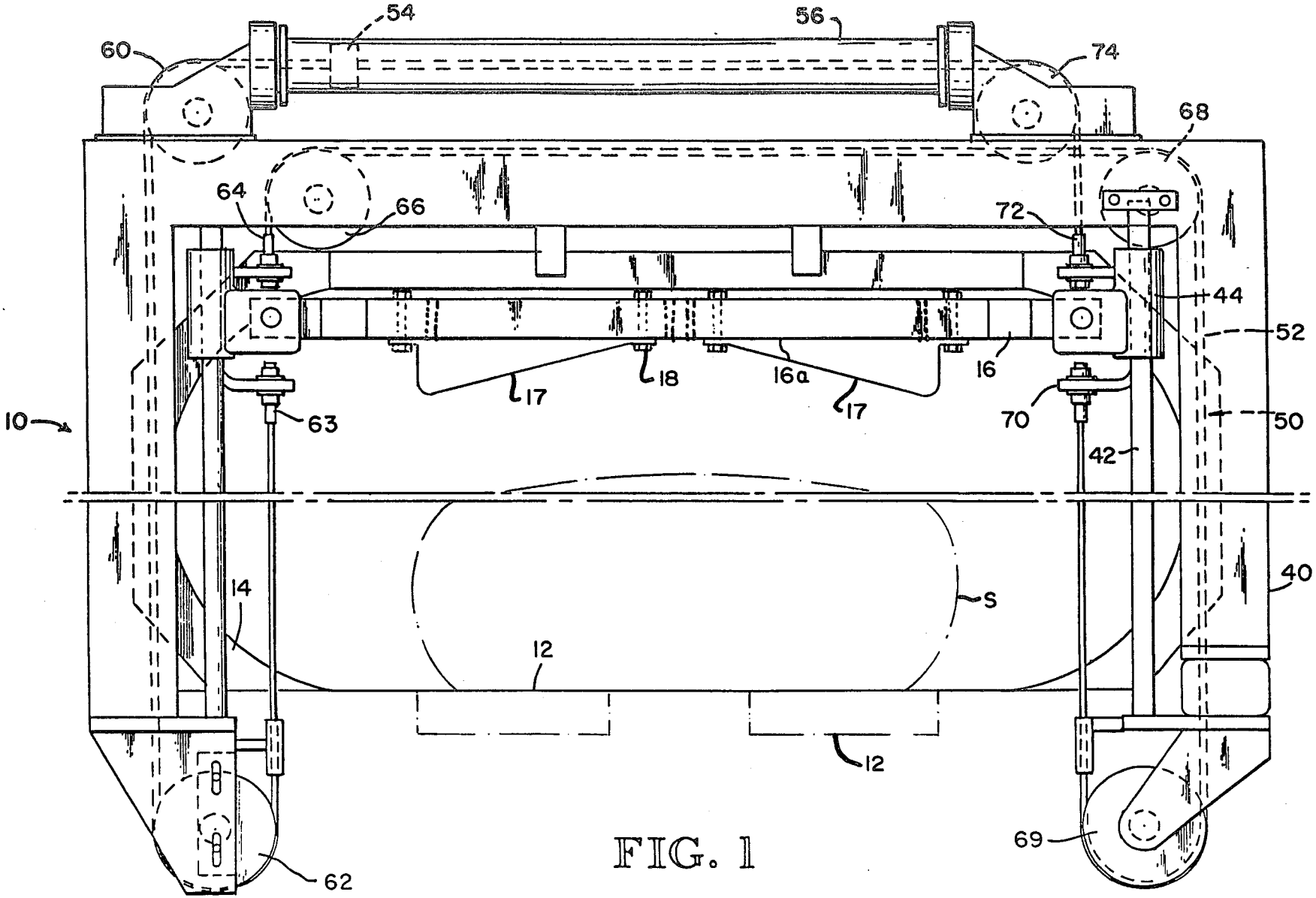
FIG. 1 is a fragmentary front elevation looking into the strapping machine in the direction of conveyor movement into the strapping station.
Figure 2:
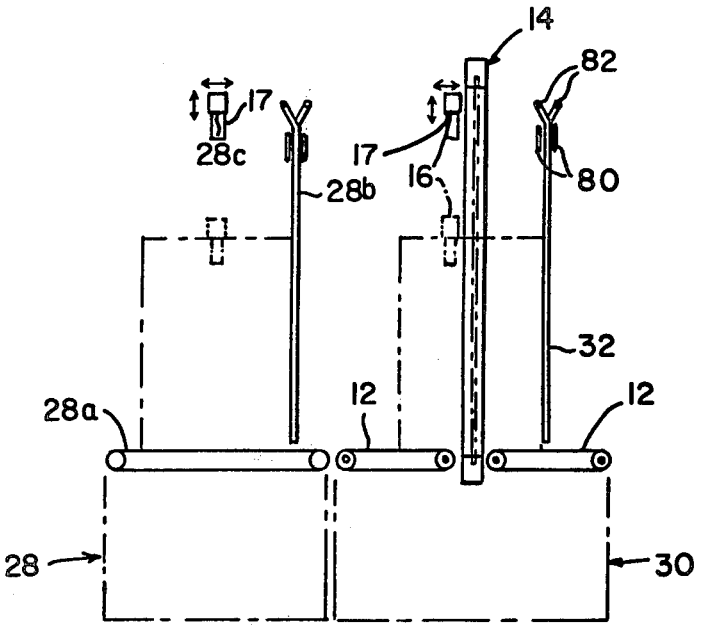
FIG. 2 is a schematic illustration of a side elevation of a strapping machine preceded by an accelerating stack feeding unit.
Figure 3:
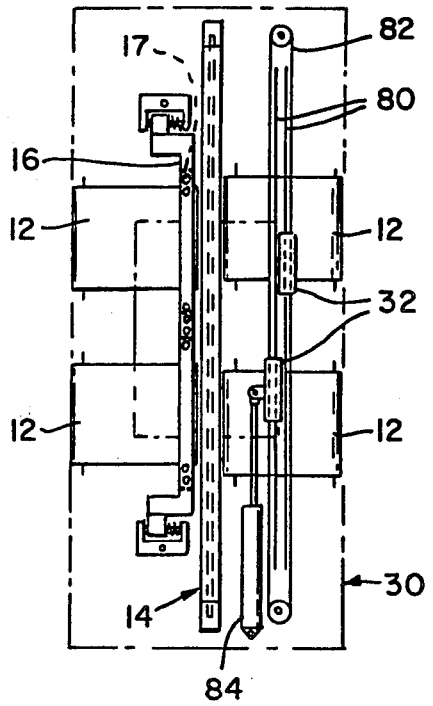
FIG. 3 is a schematic plan illustrating the arrangement of conveyors and stops for locating a stack at a strapping station.

As best shown in FIG. 1, a strapping machine is provided with an arch 10 which encircles a strapping station above a conveyor 12 of the strapping machine. The conveyor preferably is in the form of two synchronously driven spaced belts. As is well understood, the strapping station is surrounded by a strap track shown partially as 14. Strap is encircled around the object or stack of papers through the strap track at the strapping station and when the strap is then pulled or tensioned tight, it leaves the strap track in a loop closing completely around the stack and is then sealed.

Positioned above the conveyor is a compactor beam 16 which is carried in a frame. The frame can be lowered and raised to compact the stack resting on the conveyor and preferably can be lowered all the way to the conveyor surface for handling any size stack. In general, the beam is lowered onto the stack and compresses the stack as the strap is tensioned around the stack. Once the strap is sealed, the conveyor is accelerated to remove the stack from the strapping station to be replaced by a new stack. It is during this period of rapid acceleration necessary for a high production machine that the stack is unstable. The compactor beam 16 is mounted to the frame via linear ball bearings which ride on a shaft. This allows the compactor to continue to press the stack against the conveyor during the acceleration since the compactor is free to follow the stack for a short distance. The ball bearings have very low friction so that the compactor beam provides essentially only a minimal amount of drag on the top of the stack but rather is carried along with the stack. The compactor pressing the stack against the conveyor assures a fast start since slippage between the conveyor and the stack is minimized. As thus far described, the device is the same as described in said application Ser. No. 908,814 the details of which are incorporated herein by reference thereto.

The compactor beam 16 preferably is provided with compressor blocks 17 which are adjustably positioned along the beam 16 by bolts 18. A stack S frequently is bowed upwardly at its lateral ends because of inserts placed for example in the center of newspapers making up the stack. For this reason the desired friction between the ends of the stack and the conveyor belts 12 is not obtained thus limiting the acceleration of the stacks. The compression blocks 17 can be positioned over the ends of the stack so that as the beam 16 is lowered the main compression forces are applied directly to the upwardly bowed ends of the stack bending them down tight against the belts 12. The blocks can be moved away from one another to positions where not required for compacting or can be moved closer together for smaller stacks. An accelerating unit 28 can be placed ahead of the strapping unit 30 with the accelerating unit having its own conveyor 28*a* with blocks 17, stops 28*b* and its compacting accelerator hold-down bar 28*c*. The strapping machine 30, of course, has its own conveyor 12, strap track 14, hold-down accelerator bar 16 and stops 32.

In operation of the combined unit, the stops 28*b* are positioned in front of the on-coming bundle or stack and the bundle is carried very rapidly by the conveyor 28*a*. As the bundle approaches the stop 28*b* it passes a conventional switch and conventional photocell which de-energizes the conveyor 28*a* allowing the bundle to decelerate and eventually hit the stops 28*b*. The accelerator hold-down bar 28*c* is lowered onto the bundle and the stops 28*b* are removed. When the strapping machine is clear, the conveyor is accelerated to rapidly feed a bundle into the strapping station at the strapping machine 30. Again, the conveyor 12 picks up this rapidly moving bundle and, after a short movement, passes another switch and photocell sensor to de-energize the conveyor 12 allowing the bundle to decelerate and finally come to rest against the stops 32. Next the top conpactor bar 16 comes down compressing the stack, the strap is applied next to the compactor and while the strap is being applied, the stops 32 are opened. Next the conveyor is accelerated with the compactor bar still down and after approximately 0.04 seconds, the top compactor is raised but during this period has moved with the conveyor until it is almost at full speed. After the bundle clears the stops, the stops are closed again. As the compactor bar is raised, it is pushed back to its home position adjacent the strap track by the springs. The conveyors when de-energized will stop with the bundle coasting into the bundle stops. As can be readily seen with or without the addition of the accelerating section 28, the hold-down bar enables very rapid accelerations of the bundles.

The bundle stops 32 preferably are mounted for horizontal reciprocation in guides 80 and are coupled to opposite runs of an endless overhead cable 82. A cylinder and piston 84 is coupled to one of the stops and by movement of this one stop both stops separate or come together synchronously.

The details of the compactor bar will now be described, these details being applicable to the separate accelerator section 28 also. The arch 10 comprises a generally rectangular inverted U-shaped frame 40 which supports a pair of bars 42 vertically arranged on opposite sides of the strapping station. The bars slidably carry brackets 44 each of which support a shaft.

The compactor bar opposite ends can be lowered and raised synchronously by a cable system 50. The cable system includes a cable 52 having one end attached to a piston 54 in a pneumatic cylinder 56. The cable leaving the left hand side of the piston 54, as shown in FIG. 1, travels around an upper first sheave 60 down to a lower second sheave 62 and then up to be dead ended or connected as at 63 to one of the ends of the compactor bar. The cable is then again connected as at 64 above the compactor bar travels about an upper third sheave 66 and across over the strapping station to an upper fourth sheave 68. The cable travels around the fourth sheave to a lower fifth sheave 69 and then up to be again connected to the opposite end of the compactor bar as at 70. The cable then is connected again at the upper end of the compactor bar as at 72 passes around an upper sixth sheave 74 and thence back to the opposite side of the piston 54. As can be readily seen as the piston is stroked to the right the cable at 63 and the cable at 70 will be pulling down synchronously on opposite ends of the compactor bar. When the piston is moved to the left, the opposite ends of the compactor bar are raised synchronously.

While the preferred embodiments of the invention have been illustrated and described, it should be understood that variations will be apparent to one skilled in the art without departing from the principles herein. Accordingly, the invention is not to be limited to the specific embodiment illustrated in the drawing.

I claim:

1. A compactor accelerator device comprising:

a movable conveyor having a conveying surface, means for accelerating the conveyor, compactor means overlying the conveyor, means for positioning the compactor means at a variety of positions remote from and closely adjacent to the conveying surface, means for mounting the compactor means on said positioning means for movement along a path parallel to the conveying surface when the compactor means is in engagement with an article thereby holding the article against the conveying surface, said conveyor having laterally spaced runs underlying the ends of the article, said article being a stack bowed upwardly at its lateral ends, and wherein said compactor means includes spaced, downwardly depending compression blocks which press against the top laterally spaced ends of the stack and thus keep the stack ends tight against the conveyor runs.

2. The apparatus of claim 1, said compactor being mounted for free unpowered movement and being moved by the article on the surface, and including means for returning the compactor means to its original position after being moved by the stack.

3. The apparatus of claim 2, said compacting means including a bar, said means for mounting the compacting means for free unpowered movement including frame means positioned on opposite lateral sides of said conveying surface and having parallel ways, bearing means on opposite ends of said bar movable in said ways for guiding movement of said bar parallel to said conveying surface.

* * * * *